US007580003B1

(12) United States Patent
Davis et al.

(10) Patent No.: US 7,580,003 B1
(45) Date of Patent: Aug. 25, 2009

(54) SUBMARINE QUALIFIED ANTENNA APERTURE

(75) Inventors: Mark R. Davis, Bellevue, WA (US); Richard N. Bostwick, North Bend, WA (US); David N. Rasmussen, Renton, WA (US); Gary E. Miller, Auburn, WA (US)

(73) Assignee: The Boeing Company, Chicago, IL (US)

( * ) Notice: Subject to any disclaimer, the term of this patent is extended or adjusted under 35 U.S.C. 154(b) by 70 days.

(21) Appl. No.: 11/557,227

(22) Filed: Nov. 7, 2006

(51) Int. Cl.
*H01Q 13/00* (2006.01)

(52) U.S. Cl. ..... 343/872; 343/719

(58) Field of Classification Search ..... 343/770, 343/782, 719
See application file for complete search history.

(56) References Cited

U.S. PATENT DOCUMENTS 3,413,640 A * 11/1968 Freeman et al. ..... 343/771
3,629,034 A * 12/1971 Kuroda ..... 156/219
4,570,166 A * 2/1986 Kuhn et al. ..... 343/872
5,272,487 A * 12/1993 Pantsios ..... 343/727
5,276,455 A * 1/1994 Fitzsimmons et al. ..... 343/777
5,439,538 A * 8/1995 Perry ..... 156/63
5,886,671 A * 3/1999 Riemer et al. ..... 343/776
6,322,866 B1 * 11/2001 Sloot ..... 428/40.1
6,670,930 B2 * 12/2003 Navarro ..... 343/776
6,768,471 B2 * 7/2004 Bostwick et al. ..... 343/853
7,132,990 B2 * 11/2006 Stenger et al. ..... 343/754
2006/0038732 A1 * 2/2006 DeLuca et al. ..... 343/754

* cited by examiner

*Primary Examiner*—Tan Ho
(74) *Attorney, Agent, or Firm*—McNees Wallace & Nurick, LLC

(57) ABSTRACT

An antenna aperture for mounting on the outside mast structure of a submarine is disclosed. The antenna aperture is designed to withstand hydrostatic pressure cycles as would be experienced by a submarine. The antenna is constructed of a highly corrosion resistant housing upon which a wide angle impedance (WAIM) cover designed to meet antenna RF requirements is integrated.

17 Claims, 2 Drawing Sheets

SUBMARINE QUALIFIED ANTENNA APERTURE

This invention was made with Government support under Navy contract #N66604-99-C-2966 Submarine Multi-band Communications Antenna.

FIELD OF THE INVENTION

The present invention is directed to an antenna aperture formed of a housing and a wide angle impedance matching (WAIM) cover designed to be mounted on the outside structure of a submarine.

BACKGROUND OF THE INVENTION

Antennas are widely used to transmit and receive a variety of signals. For example, antennas are prevalent in radio frequency (RF) communications systems. To be effective, the antenna must be capable of transmitting or receiving RF energy from an outside environment. In an application, such as an antenna mounted external to a submarine, the aperture must provide protection from the outside environment, including pressures encountered at submarine ocean depths.

Until now, antennas on submarines have been designed as retractable tow assemblies that are stored in pressurized housing structures and deployed from the submarine for transmission or as mast mounted pressure compliant domed radomes. The deployable antenna has two significant limitations. First, time is required before transmission may begin to allow for the antenna to be physically deployed. Second, problems may arise with the mechanical deployment system of the antenna, leading to antenna failure or degradation. The domed radome has the disadvantage that in order to survive the pressure environment, the radome wall thickness must be substantial, which severely degrades RF signal propagation A need exists to place an antenna aperture upon a submarine mast in order to provide for communications via the antenna to and from the submarine without the deployment of an antenna tow assembly and without the high RF signal loss resulting from radomes. The antenna aperture must allow for RF transmissions from a submarine antenna, as well as provide a barrier against the outside environment, including hydrostatic forces for the antenna electronics. The antenna aperture should preferably be mast mounted.

To provide an aperture for the isolation of antenna electronics external to the submarine, an antenna aperture must be designed and tested to meet hydrostatic pressure cycling to ensure acceptable performance on a submarine.

An antenna aperture that meets these needs would require both a high strength structural member and a wide angle impedance matching (WAIM) radome cover. The WAIM cover must meet both RF requirements and environmental requirements including hydrostatic pressure requirements.

Other features and advantages of the present invention will be apparent from the following more detailed description of the preferred embodiment, taken in conjunction with the accompanying drawings that illustrate, by way of example, the principles of the invention.

SUMMARY OF THE INVENTION

An antenna aperture and method of making the antenna aperture are provided to address the aforementioned and other disadvantages associated with towed antenna systems and mast mounted domed radome antenna systems. The antenna aperture includes an antenna housing and a wide angle impedance matching (WAIM) cover. The antenna housing is formed of a high strength corrosion resistant steel. The steel may be a superaustenitic stainless steel, such as AL6XN™ of the Allegheny Ludlum Corporation. Other high strength corrosion resistant materials may be used depending upon the environmental conditions surrounding the housing.

AL6XN™, although classified as nickel-base alloy by the UNS system, is part of the "superaustenitic" category of stainless steels. This iron-based superaustenitic stainless steel alloy was developed for improved resistance to chloride corrosion. The alloy has a high nickel and molybdenum content.

Radiating aperture waveguide holes are cut through the front surface of the antenna housing and are dielectrically loaded using slip-fit plugs made of a cross-linked polystyrene, such as Rexolite™ made by C-Lec Plastics, Inc. To seal the waveguide holes in the antenna housing against environment conditions including high hydrostatic pressures, and to optimize transmission of RF signals, a WAIM cover is attached over the housing surface containing the waveguide holes.

The housing has a base that is sealed to prevent water intrusion at submarine pressures and to provide access to an electronics provided within. The electronic connections that pass through the base of the housing are sealed by known seal coupling techniques.

The WAIM of the current invention is formed of several material layers stacked into a sandwich composite structure. A sandwich composite structure may be formed of a first layer, in order from attachment to the housing, of a film base adhesive layer. An adhesive meeting or exceeding specifications for AF-163-2U is used in this embodiment. A foam sheet with a density of approximately 30 lbs/ft$^3$, such as FR6730 Foam produced by General Plastics, is applied over the adhesive, and the outer edge of the foam sheet is tapered to improve sealing the foam against the environment. A second layer of film adhesive of the same or similar material as the base adhesive layer is placed upon the foam sheet. A facesheet of a cyanate ester impregnated quartz mat, such as Astroquartz™ produced by JPS Industries Inc., is then placed upon this second layer of adhesive.

The composite structure of the housing with inserts, base adhesive layer, foam, second adhesive layer, and the facesheet are then heated under pressure to flow the adhesive and substantially integrate the composite structure and bond the WAIM to the housing.

The adhesive may be an impregnated single or multi-ply mat, or may be an applied or film adhesive. The mat material may be a glass fiber mat material.

The WAIM may be formed without the second adhesive layer between the facesheet and the foam so as to co-cure or co-bond the facesheet directly to the foam. The removal of the second adhesive layer may weaken the strength of the bond between the facesheet and the foam and may not be practical depending upon the hydrostatic cycling required by the WAIM.

A final layer of an appliqué is then applied upon the facesheet to ensure an environmental barrier at elevated pressure. The appliqué is typically an organic resin matrix elastomeric composite, in particular, a fluoroelastomer of about 0.0056 inch thick. The appliqué may have a pressure sensitive adhesive coating on the side applied to the facesheet. The appliqué may be applied by any suitable means to assure that no air is trapped under the appliqué, such as by a hand roller and an airblow heat gun. The outer circumference of the appliqué covered WAIM is then sealed to the antenna housing with a silicone-based sealant to form the antenna aperture.

The silicone-based sealant may be air dried or heated to form a WAIM edge seal. The silicone based sealant may be pliable or hard upon curing.

It should be appreciated that the foam layer could be joined by an adhesive to the facesheet prior to attachment to the housing by the base adhesive layer. The structure could then be heated under pressure to integrate the composite structure to the antenna housing, followed by application of the appliqué and silicone sealer to complete the aperture.

Further aspects of the method and apparatus are disclosed herein. The features as discussed above, as well as other features and advantages of the present invention will be appreciated and understood by those skilled in the art from the following detailed description and drawings.

DETAILED DESCRIPTION OF THE INVENTION

The present invention now will be described more fully hereinafter with reference to the accompanying drawing, in which a preferred embodiment of the invention is shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
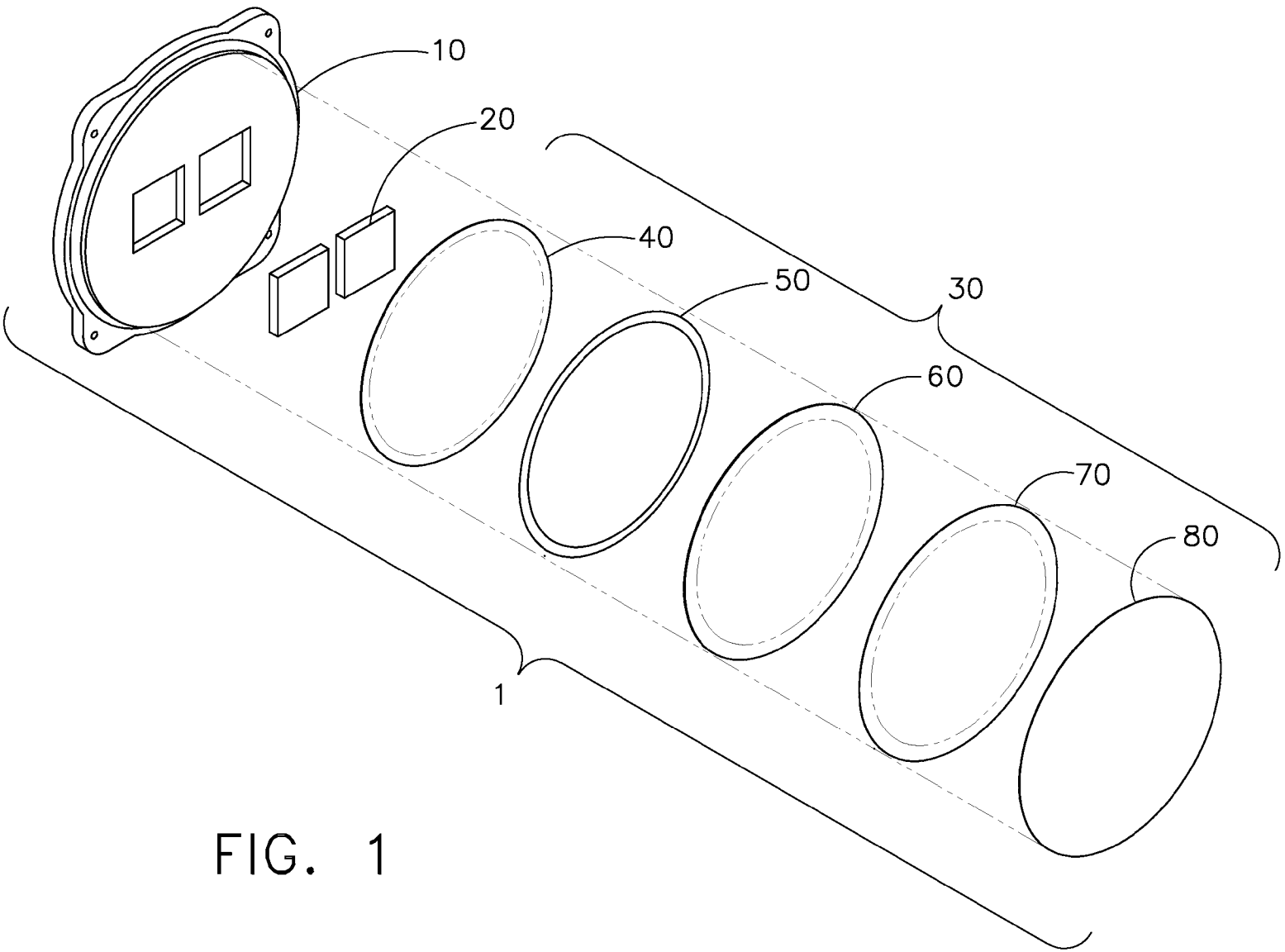
FIG. 1 shows a composite view of an embodiment of the antenna aperture of the current invention.

Referring to FIG. 1., there is illustrated a pre-assembled view of a phased array antenna aperture 1 in accordance with a preferred embodiment of the present invention. It will be appreciated, however, that the present invention is not limited to the selected number of layered sheets, or specific thicknesses of the separate layers, but that the principals and teachings as set forth herein could be used to produce an antenna aperture having a different number of layers or of different layer thickness and qualities based on the particular RF transmission and antenna environment selected. The thickness and number of layers are used to optimize RF performance across the antenna design frequency and scan volume.

Figure 2:
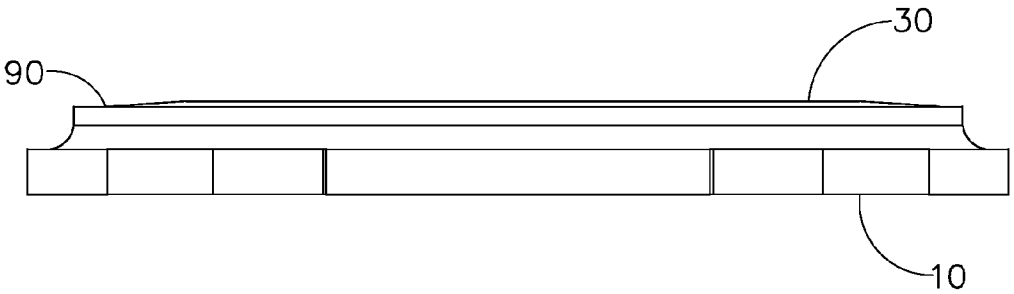
FIG. 2 shows a profile view of a WAIM cover attached to a housing.

The aperture 1 is formed of a housing 10 into which are cut waveguide holes. The housing is formed of a high strength corrosion resistant steel such as a superaustenitic stainless steel of AL6XN designation. Dielectric waveguide inserts 20 formed of slip-fit plugs of a cross-linked polystyrene are loaded into the holes. A WAIM cover, or simply WAIM 30, is formed over the dielectrically loaded antenna housing to seal the housing from any exterior environment. The overall structure of the aperture 1 is shown in FIG. 2.

The WAIM 30 is formed of a base adhesive layer 40, a foam sheet 50, an adhesive layer 60, a facesheet 70, and an appliqué 80, layered upon the dielectrically loaded antenna housing 10. The WAIM 30 performs two functions. It is designed to minimize active impedance induced mismatch loss at high scan angles from boresight and it seals the housing containing the waveguide inserts from the environment. The design of the WAIM 30 assumed exterior submarine conning tower surface exposure or mast to environmental conditions encountered during normal surface and subsurface submarine operations.

The first step in forming the aperture 1 is to cut waveguide holes in the radiating surface of the antenna housing. Waveguide holes are cut through the front surface of the antenna housing by any conventional method including machining and drilling. The waveguide holes are then dielectrically loaded using waveguide inserts 20 formed of slip-fit plugs made of a cross-linked polystyrene, such as Rexolite™ by C-Lec Plastics. The number of waveguide holes is dependant upon the phased array application and may include a single hole or two or more holes. The number of machined waveguide holes may be the same as the number of waveguide inserts 20. Some machined waveguide holes may be loaded with a filler or other material if not required for the specific antenna configuration.

The WAIM 30, designed to withstand environmental and high hydrostatic pressures and optimized for RF transmission, is placed over the surface of the housing 10 with the waveguide holes containing the waveguide inserts 20. The WAIM 30 is then joined to the housing 10 by heating under pressure. An appliqué 80, and then an edge sealant 90, are applied to seal the WAIM 30 to the antenna housing 10 against environmental and applied hydrostatic pressure.

Figure 3:
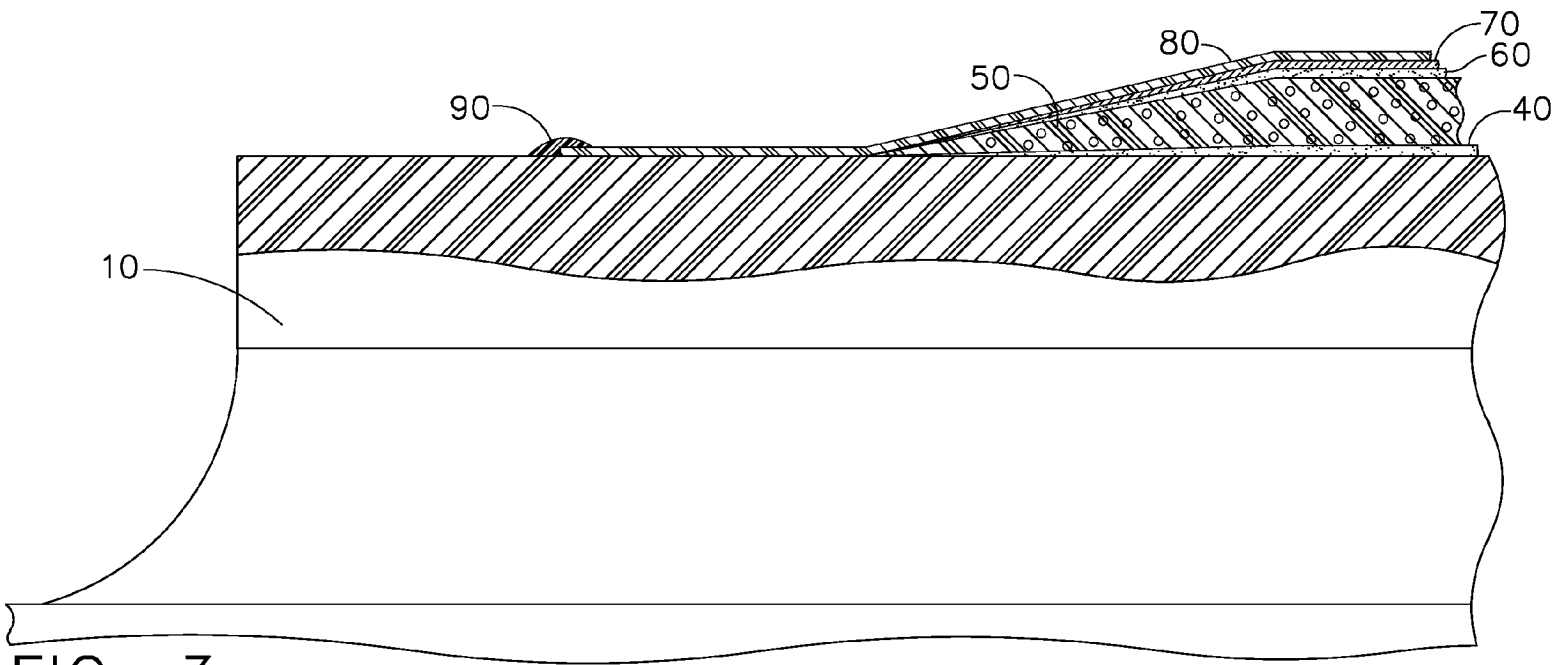
FIG. 3 shows a cross-sectional view of a WAIM cover attached to a housing.

Referring to FIG. 3., the WAIM 30, of this embodiment, is formed of several material layers of substantially circular construction, although it is not limited to this geometry. The first layer is a base adhesive layer 40. The base adhesive layer 40 may be formed of an adhesive impregnated single or multi-ply mat, depending upon the desired structural strength of the adhesive layer. The base adhesive layer 40 is approximately 0.006 inches thick. The adhesive is selected to flow under elevated temperature and pressure, and for this application, meets or exceeds specifications for AF-163-2U.

Upon the base adhesive layer 40, a foam sheet 50 with a density of about 30 lbs/ft$^3$ is applied. The foam sheet 50 has a thickness of about 0.04 inches. The outer circumferential surface of the foam sheet 50 is tapered to a sharp edge to improve sealing against the environment. The thickness of the outer edge of the taper is approximately 0.01 inches. The taper is outward towards the base adhesive layer 40 and joins the base adhesive layer 40 at an angle of 3.81 degrees. The taper ends before reaching the outside edge of the base adhesive layer 40.

Upon the foam sheet 50 is applied a second adhesive layer 60 that may be the same adhesive impregnated single ply mat as the base adhesive layer 40. The adhesive layer 60 is applied to cover the entire foam sheet 50 to the outer edge of the base adhesive layer 30. The thickness of the adhesive layer 60 is approximately 0.006 inches.

A facesheet 70, typically formed of a cyanate ester impregnated quartz mat, such as Astroquartz™, is placed upon the adhesive layer 60. The thickness of the facesheet 70 is approximately 0.005 inches in this embodiment. The facesheet 70 extends to the circumferential edge of the adhesive layer. When the facesheet 70 is applied with an adhesive layer 30 underneath, the facesheet is provided in a precured condition. The facesheet 70 may be applied uncured, however, in this condition the adhesive layer 60 is omitted and the facesheet is applied directly to the foam sheet and is cured and bonded to the foam sheet 50 in a later heating process.

A final appliqué 80 is placed upon the facesheet 70 to provide an exterior surface. The appliqué 80 is typically an organic resin matrix elastomeric composite, particularly a fluoroelastomer with a thickness of about 0.006 inches.

The WAIM 30 is consolidated and formed by a hot pressing method, such as an autoclave process. Referring again to FIG. 1., WAIM elements 40, 50, 60, and 70 are stacked upon the housing 10 that has waveguide inserts 20 in place. The antenna housing 1 and the WAIM elements 40, 50, 60 and 70 are then placed in an inert vacuum bag. The atmosphere of the bag is removed under vacuum, and the bag is then placed in an autoclave. The bag is heated to a temperature of about 250° F. at a pressure of approximately 10-12 psi until the adhesive flows and forms a bond of the stacked elements. After removal from the autoclave and allowing sufficient time to cool, the appliqué 80 is applied. As shown in FIG. 3, a thin coating of a silicone-based sealant 90 is applied to the outer circumference of the WAIM 30 and housing 10 to complete the seal against environmental effects and applied hydrostatic pressure. The silicone-based sealant may be pliable or hard upon curing. FIGS. 2 and 3 show the taper of the WAIM 30 onto the housing 10.

An antenna aperture 1 was constructed of a housing of AL6XN™ that had waveguide holes cut into a top surface. Slip-fit dielectric plugs 20 formed of Rexolite™ were loaded into the cut holes. To seal the waveguide holes in the antenna housing, the WAIM cover was attached over the housing surface containing the waveguide holes.

The WAIM was formed of several material layers stacked into a sandwich composite structure. The first layer, in order from attachment to the housing, was a film base adhesive layer 40 meeting or exceeding specifications for AF-163-2U. The base adhesive layer was an impregnated single ply mat approximately 0.0059 inches thick. A foam sheet 50 of FR6730 Foam by General Plastics with a density of about 30 lbs/ft$^3$ was applied over the adhesive. The foam sheet 50 had a thickness of about 0.0422 inches. The outer circumferential surface of the foam sheet 50 was tapered to a sharp edge to improve sealing against the environment. The thickness of the outer edge of the taper was approximately 0.010 inches. The taper was outward towards the base adhesive layer and joined the base adhesive layer 40 at an angle of 3.81 degrees. The taper ended before reaching the outside edge of the base adhesive layer 40 by approximately 0.475 inches. A second layer of a film adhesive 60 of an impregnated single ply mat of the same composition as the base was placed upon the foam sheet. A procured facesheet 70 of a cyanate ester impregnated quartz mat of approximately 0.005 inches thick Astroquartz™ produced by JPS Industries Inc., was then placed upon this second layer of adhesive 60.

The composite structure of the housing with inserts, base adhesive layer 40, foam 50, second adhesive layer 60, and a procured facesheet 70 was placed in a vacuum bag. The vacuum bag was then placed into an autoclave, a vacuum applied to the bag, and heated to approximately 250° F. under a pressure of approximately 10-12 psi to flow the adhesive and substantially integrate the composite structure.

A final appliqué 80 was placed upon the facesheet of the composite structure to provide an exterior surface. The appliqué 80 was an organic resin matrix fluoroelastomeric composite with a thickness of about 0.0056 inches. The appliqué 80 had a pressure sensitive adhesive on the side placed against the facesheet 70 and was applied by hand rolling and heating with an airblow heat gun. The outer circumference of the WAIM 30 and housing 10 was then sealed with a pliable silicone-based sealant 90 and air dried to form the antenna aperture 1.

This antenna aperture design, Band 1*a*—20.2-21.2 GHz, was successfully tested under hydrostatic pressure test cycling from 0 psi to 1000 psi to 0 psi, a total of 500 times. The rate of change from 0 psi to 1000 psi was set to 250 psi per minute. The pressure was then held at 1000 psi for 5 minutes. The rate of change from 1000 psi to 0 psi was set at a rate of 250 psi per minute. The antenna aperture had no leakage under these test conditions and met performance requirements of the designed bandwidth.

Antenna apertures were designed for operation in three bandwidth coverages. The separate approximate band widths were Band 1=17.2-21.2 GHz, Band 2=27.5-31.0 GHz, and Band 3=43.5-45.5 GHz. The apertures were designed to meet these three bandwidth coverages by choosing waveguide element diameters, dielectric loading and lattice spacing to meet this requirement, the determination of these parameters easily determined by one skilled in the art.

WAIM performance was optimized across each frequency bandwidth and throughout the entire design scan volume, $\theta$=0 to 60 degrees and $\phi$=0 to 360 degrees by selecting waveguide diameters and waveguide insert dielectrics to meet the design requirements.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An antenna aperture comprising:
- a housing;
- a waveguide hole in a surface of the housing;
- a plug of a dielectric material inserted into said waveguide hole;
- a wide angle impedance matching (WAIM) cover over the surface of the housing having the waveguide hole; and
- a sealant applied to the housing and the WAIM cover to seal the WAIM cover to the housing;
- wherein the WAIM cover comprises
  - a layer of a foam;
  - a first layer of an adhesive bonding the foam layer to the housing;
  - a layer of a facesheet;
  - a second layer of an adhesive between the foam layer and the facesheet bonding the facesheet to the foam layer; and
  - a layer of an appliqué bonded to the facesheet.

2. The antenna aperture of claim 1 wherein the antenna housing comprises a high strength corrosion resistant material.

3. The antenna aperture of claim 2, wherein the high strength corrosion resistant material is a steel.

4. The antenna aperture of claim 3, wherein the steel is a stainless steel.

5. The antenna aperture of claim 1, wherein the foam layer is formed of a closed cell foam with a minimum density of about 30 pounds per cubic foot.

6. The antenna aperture of claim 1, wherein the foam layer comprises a tapered outer edge.

7. The antenna aperture of claim 1, wherein the first layer of an adhesive comprises an impregnated single ply mat.

8. A wide angle impedance matching (WAIM) cover, comprising:
- a layer of a foam;
- a first layer of an adhesive for bonding the foam layer to a housing;
- a layer of a facesheet;

a second layer of an adhesive between the foam layer and the facesheet bonding the facesheet to the foam layer; and a layer of an appliqué bonded to the facesheet to form the WAIM cover.

9. The WAIM cover of claim 8, wherein the foam layer is formed of a closed cell foam with a minimum density of about 30 pounds per cubic foot.

10. The WAIM cover of claim 8, wherein the facesheet comprises a cyanate ester impregnated quartz fiber sheet.

11. The WAIM cover of claim 8, wherein the foam layer comprises a tapered outer edge.

12. The WAIM cover of claim 8, wherein the facesheet layer comprises a tapered outer edge.

13. A method of making an antenna aperture, comprising:

providing a housing comprising a surface comprising holes;

inserting plugs of a dielectric material into the holes;

placing a base adhesive layer upon the surface;

placing a foam layer upon the base adhesive layer;

placing a second adhesive layer upon the foam layer;

placing a facesheet upon the second adhesive layer;

heating under pressure the housing with the plugs, the base adhesive layer, the foam layer, the second adhesive layer, and the facesheet to form an integrated composite structure;

applying an appliqué upon the facesheet of the integrated composite structure; and sealing the appliqué to the housing.

14. The method of claim 13, wherein the adhesive is an impregnated single ply mat.

15. The method of claim 13, wherein the foam layer is formed of a closed cell foam with a minimum density of about 30 pounds per cubic foot.

16. The method of claim 13, wherein the housing is a high strength corrosion resistant material.

17. The method of claim 16, wherein the high strength corrosion resistant material is a stainless steel.

* * * * *